US007374276B2

(12) United States Patent
Taira et al.

(10) Patent No.: US 7,374,276 B2
(45) Date of Patent: May 20, 2008

(54) INKJET PRINTING HEAD AND PRINTER

(75) Inventors: Hiroshi Taira, Aichi (JP); Ayumu Matsumoto, Aichi (JP)

(73) Assignees: Brother Kogyo Kabushiki Kaisha, Nagoya (JP); Kyocera Corporation, Kyoto (JP)

( * ) Notice: Subject to any disclaimer, the term of this patent is extended or adjusted under 35 U.S.C. 154(b) by 249 days.

(21) Appl. No.: 10/879,119

(22) Filed: Jun. 30, 2004

(65) Prior Publication Data

US 2005/0030348 A1 Feb. 10, 2005

(30) Foreign Application Priority Data

Jun. 30, 2003 (JP) ..... P2003-187549

(51) Int. Cl.
*B41J 2/045* (2006.01)

(52) U.S. Cl. ..... 347/68; 347/42

(58) Field of Classification Search ..... 347/67–72, 347/42, 49, 43

See application file for complete search history.

(56) References Cited

U.S. PATENT DOCUMENTS

2002/0075362 A1 6/2002 Nakamura et al.
2002/0080215 A1 6/2002 Sakaida et al.
2003/0001931 A1 1/2003 Isono

FOREIGN PATENT DOCUMENTS

| | | |
|---|---|---|
| EP | 0 884 184 A1 | 12/1998 |
| EP | 0 976 560 A2 | 2/2000 |
| EP | 1 199 171 A2 | 4/2002 |
| EP | 1 316 424 A2 | 6/2003 |
| JP | A-9-323409 | 12/1997 |
| JP | A-11-138796 | 5/1999 |
| JP | A 11-291487 | 10/1999 |
| JP | A-2002-127408 | 5/2002 |
| JP | A 2002-292860 | 10/2002 |
| JP | A-2002-374675 | 12/2002 |
| JP | A-2003-159798 | 6/2003 |

*Primary Examiner*—Lamson Nguyen
(74) *Attorney, Agent, or Firm*—Oliff & Berridge, PLC

(57) ABSTRACT

An inkjet printing head includes: a flow path unit having a plurality of pressure chambers arranged along a plane and connected to nozzles; and an actuator unit fixed on a surface of the flow path unit and changes volume of each of the pressure chambers, the actuator unit including: a plurality of individual electrodes arranged in positions opposite to the pressure chambers respectively; a common electrode disposed to extend over the plurality of pressure chambers and having openings each formed at least at a part of a region opposite to the individual electrodes; and a piezoelectric sheet sandwiched between the common electrode and the individual electrodes.

16 Claims, 15 Drawing Sheets

INKJET PRINTING HEAD AND PRINTER

BACKGROUND OF THE INVENTION

1. Field of the Invention

The present invention relates to an inkjet printing head for ejecting ink onto a recording medium to perform printing.

2. Description of the Related Art

An example of inkjet printing head is disclosed in JP-A-2002-292860. The inkjet printing head disclosed in the document is formed in such a manner that a large number of pressure chambers are arranged in the form of a matrix in a flow path unit so as to be adjacent to one another, and that piezoelectric devices and one electrode (common electrode) are formed as a sheet over the plurality of pressure chambers while the other electrodes (individual electrodes) are arranged in positions opposite to the pressure chambers respectively so that the piezoelectric devices are sandwiched between the common electrode and the individual electrodes. In the inkjet printing head, the electric potential of each individual electrode is made different from that of the common electrode to thereby eject ink from a nozzle connected to a pressure chamber corresponding to the individual electrode.

SUMMARY OF THE INVENTION

In the inkjet printing head, the individual electrodes and the pressure chambers are closely arranged. For this reason, when ink is ejected from a nozzle connected to a certain pressure chamber, a crosstalk phenomenon occurs easily because vibration of the piezoelectric sheet located in a position corresponding to the pressure chamber worsens ink ejection characteristic of a nozzle connected to a pressure chamber adjacent to the pressure chamber. When crosstalk occurs, the quality of a print image is lowered. Therefore, reduction in crosstalk between the pressure chambers in the inkjet printing head is an important issue.

Therefore, one of objects of the invention is to provide an inkjet printing head in which crosstalk between pressure chambers can be reduced, and a printer including at least one inkjet printing head as defined above.

According to a first aspect of the invention, there is provided an inkjet printing head including: a flow path unit having a plurality of pressure chambers arranged along a plane and connected to nozzles; and an actuator unit fixed on a surface of the flow path unit and changes volume of each of the pressure chambers, the actuator unit including: a plurality of individual electrodes arranged in positions opposite to the pressure chambers respectively; a common electrode disposed to extend over the plurality of pressure chambers and having openings each formed at least at a part of a region opposite to the individual electrodes; and a piezoelectric sheet sandwiched between the common electrode and the individual electrodes.

According to a second aspect of the invention, there is provided a printer including: a conveyance mechanism that conveys a recording medium; and a inkjet printing head that discharges ink on the recording medium and forms an image thereon, the inkjet printing head including: a flow path unit having a plurality of pressure chambers arranged along a plane and connected to nozzles; and an actuator unit fixed on a surface of the flow path unit and changes volume of each of the pressure chambers, the actuator unit including: a plurality of individual electrodes arranged in positions opposite to the pressure chambers respectively: a common electrode disposed to extend over the plurality of pressure chambers and having openings each formed at least at a part of a region opposite to the individual electrodes; and a piezoelectric sheet sandwiched between the common electrode and the individual electrodes.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of preferred embodiments of the invention.

Figure 1:
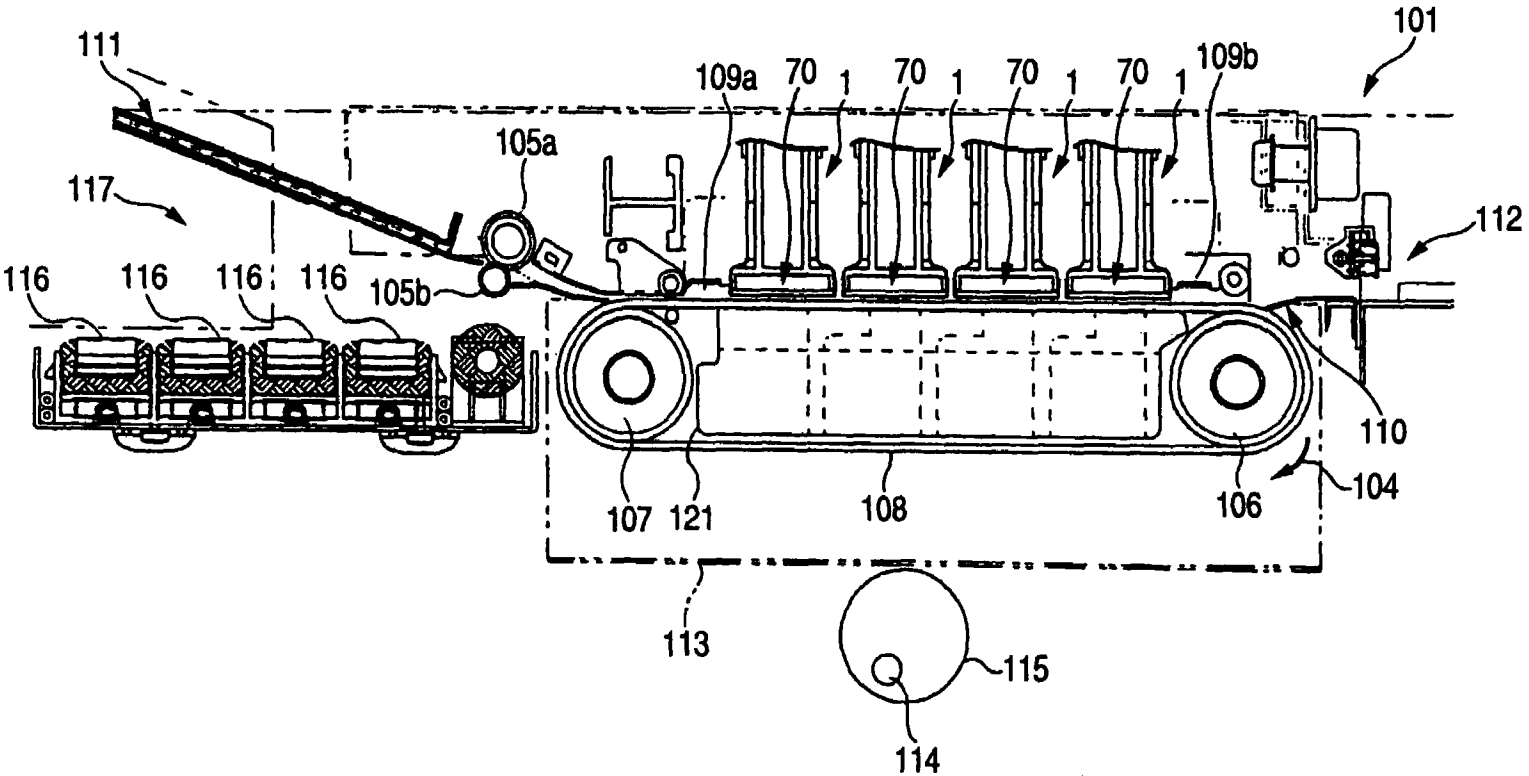
FIG. 1 is a schematic view of an inkjet printer including inkjet printing heads according to a first embodiment of the invention.

FIG. 1 is a schematic view of an inkjet printer according to a first embodiment of the invention. The inkjet printer 101 shown in FIG. 1 is a color inkjet printer having four inkjet printing heads 1. In the printer 101, a sheet feeding portion 111 is formed in the left in FIG. 1 whereas a sheet delivery portion 112 is formed in the right in FIG. 1.

A sheet conveyance path through which a sheet of paper is fed from the sheet feeding portion 111 to the sheet delivery portion 112 is formed in the inside of the printer 1. A pair of feed rollers 105*a* and 105*b* for feeding a sheet of paper as an image recording medium while holding the sheet of paper between the pair of feed rollers 105*a* and 105*b* are arranged on a side right downstream from the sheet feeding portion 111. The sheet of paper is fed from the left to the right in FIG. 1 by the pair of feed rollers 105*a* and 105*b*. Two belt rollers 106 and 107 and an endless conveyer belt 108 wound so as to be laid between the two rollers 106 and 107 are arranged in the intermediate portion of the sheet conveyance path. The outer circumferential surface, that is, the conveyer surface of the conveyer belt 108 is treated with silicone so that the sheet of paper fed by the pair of feed rollers 105*a* and 105*b* can be further fed to the downstream side (right) by drive of clockwise (in the direction of the arrow 104 in FIG. 1) rotation of the belt roller 106 while the sheet of paper is retained on the conveyer surface of the conveyer belt 108 by the adhesive force of silicone.

Presser members 109*a* and 109*b* are arranged in a position of insertion of the sheet of paper into the belt roller 106 and a position of delivery of the sheet of paper from the belt roller 106, respectively. The presser members 109*a* and 109*b* are provided for pressing the sheet of paper against the conveyer surface of the conveyer belt 108 so that the sheet of paper surely adheres onto the conveyer surface to prevent the sheet of paper on the conveyer belt 108 from floating up from the conveyer surface.

A releasing mechanism 110 is provided along the sheet conveyance path and on a side right downstream from the conveyer belt 108. The releasing mechanism 110 is formed so tat the sheet of paper adhering onto the conveyer surface of the conveyer belt 108 is released from the conveyer surface and fed to the sheet delivery port ion 112 in the right.

Each of the four inkjet printing heads 1 has a head body 70 at its lower end. Each head body 70 has a rectangular section. The respective head bodies 70 are arranged so as to be close to one another so that the lengthwise direction of each head body 70 is perpendicular to the paper conveyance direction (i.e., perpendicular to the paper surface of FIG. 1). That is, the printer 101 is a line printer. The respective bottom surfaces of the four head bodies 70 face the sheet conveyance path. A large number of nozzles 8 (see FIG. 7) each having a very small diameter are provided in each bottom surface. Four kinds of ink, namely, magenta, yellow, cyan and black are ejected from the four head bodies 70 respectively.

Each head body 70 is arranged so that a small gap is formed between the lower surface of the head body 70 and the conveyer surface of the conveyer belt 108. The sheet conveyance path is formed in the gap portion. In this configuration, when the sheet of paper conveyed on the conveyer belt 108 passes through the just lower sides of the four head bodies 70 successively, the respective kinds of ink are ejected from the nozzles toward the upper surface, that is, the print surface of the sheet of paper. In this manner, a desired color image can be formed on the sheet of paper.

The inkjet printer 101 has a maintenance unit 117 for performing maintenance of the inkjet printing heads 1 automatically. Four caps 116 for covering the lower surfaces of the four head bodies 70 and a purging mechanism not shown are provided in the maintenance unit 117.

The maintenance unit 117 is located in a position (retraction position) just under the sheet feeding portion 111 while printing is executed by the inkjet printer 101. When a predetermined condition is satisfied (e.g., when a state in which no printing operation is made is continued for a predetermined time or when the printer 101 is powered off) after completion of printing, the maintenance unit 117 moves to a position just under the four head bodies 70 so that the lower surfaces of the head bodies 70 are covered with the caps 116 in the position (capping position) respectively to prevent ink in the nozzle portions of the head bodies 70 from drying.

The belt rollers 106 and 107 and the conveyer belt 108 are supported by a chassis 113. The chassis 113 is placed On a cylindrical member 115 disposed under the chassis 113. The cylindrical member 115 can rotate around a shaft 114 attached to a position out of the center of the cylindrical member 115. For this reason, when the height of the upper end of the cylindrical member 115 changes according to the rotation of the shaft 114, the chassis 113 moves up and down in accordance with the change of the height. To move the maintenance unit 117 from the retraction position to the capping position, the cylindrical member 115 needs to be rotated by a suitable angle in advance to move down the chassis 113, the conveyer belt 108 and the belt rollers 106 and 107 by a suitable distance from the position shown in FIG. 1 to thereby keep a space necessary for moving the maintenance unit 117.

A guide 121 substantially shaped like a rectangular parallelepiped (having a width nearly equal to that of the conveyer belt 108) is disposed in a region surrounded by the conveyer belt 108 so that the guide 121 comes into contact with the lower surface of the conveyer belt 108 located in a position facing the inkjet printing heads 1, that is, located on the upper side to thereby support the lower surface of the conveyer belt 108 from the inner circumferential side.

Figure 2:
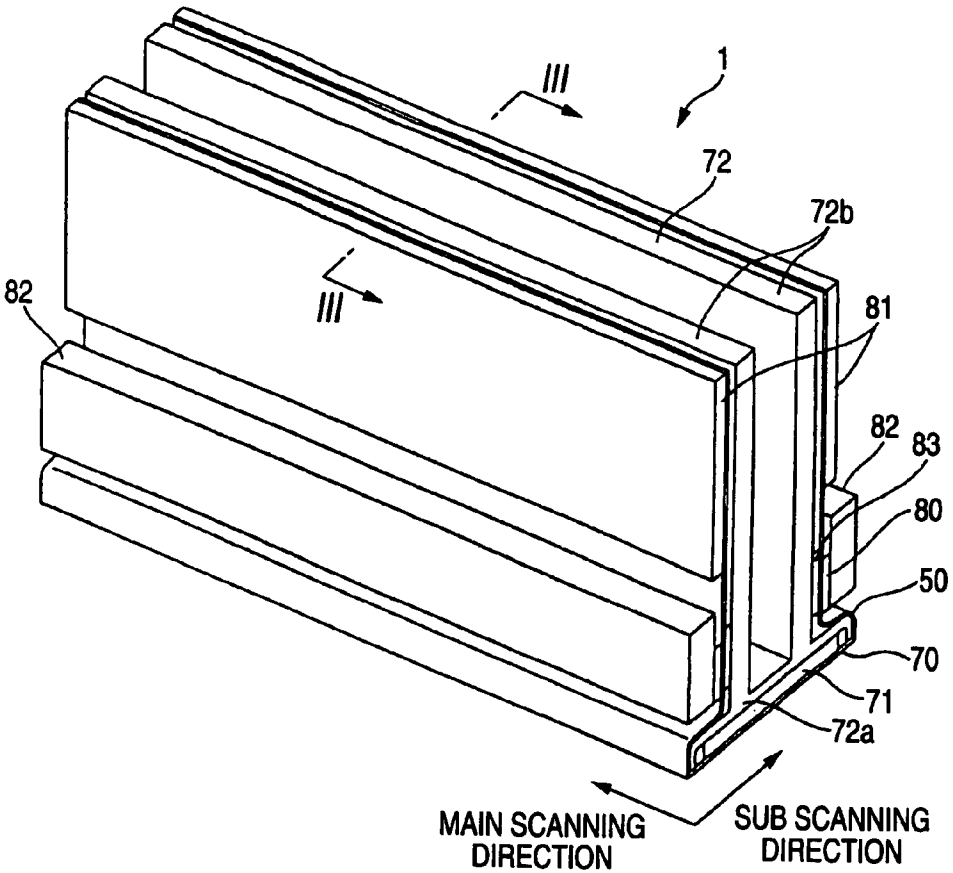
FIG. 2 is a perspective view of each inkjet printing head depicted in FIG. 1.
Figure 3:
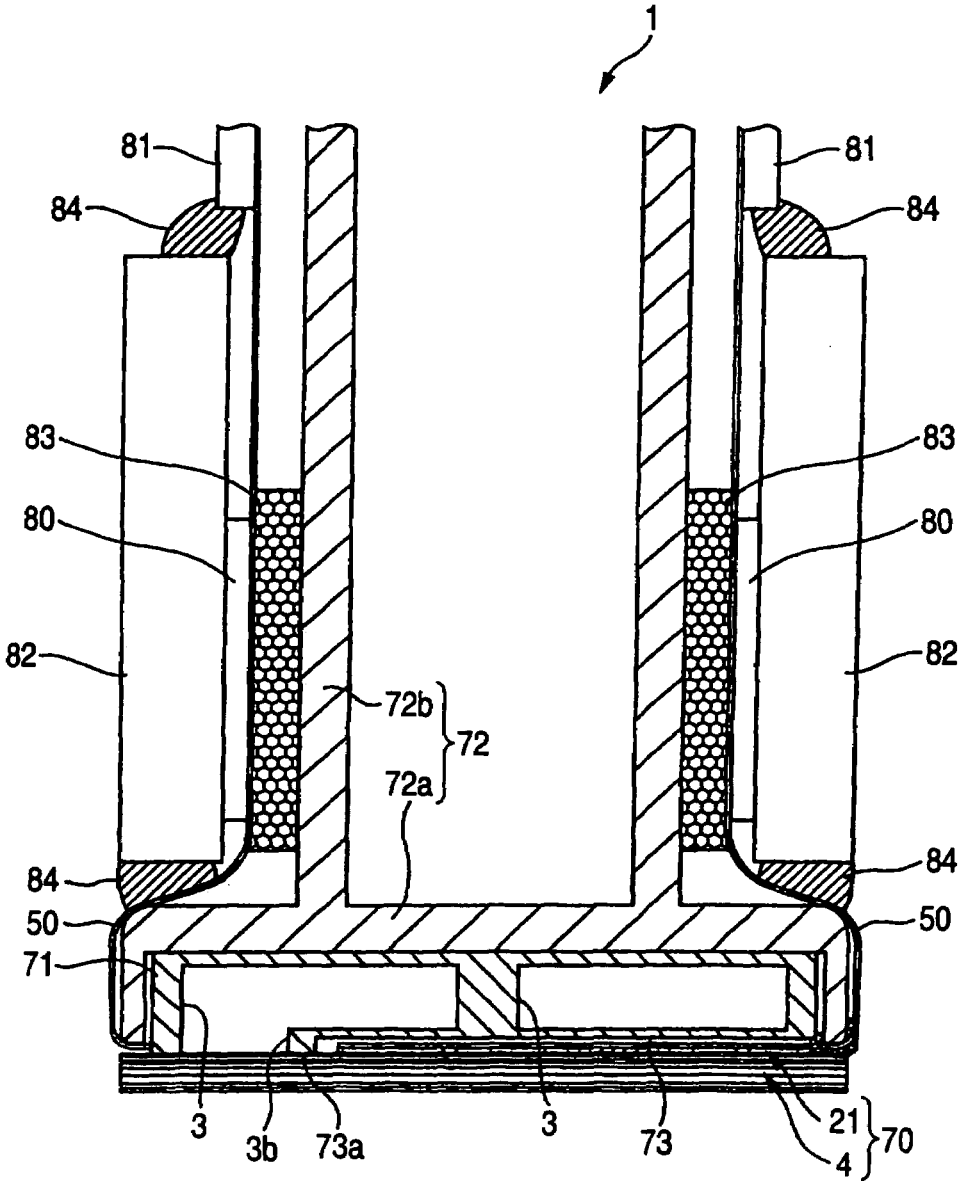
FIG. 3 is a sectional view taken along the line III-III in FIG. 2.

FIG. 2 is a perspective view showing the external appearance of an inkjet printing head 1 shown in FIG. 1. FIG. 3 is a sectional view taken along the line III-III in FIG. 2. The inkjet printing head 1 has a head body 70, and a base block 71. The head body 70 is shaped like a flat rectangle extending in a main scanning direction for ejecting ink onto a sheet of paper. The base block 71 is disposed above the head body 70 and includes ink reservoirs 3 formed as flow paths of ink supplied to the head body 70. The head body 70 includes a flow path unit 4, and a plurality of actuator units 21. An ink flow path is formed in the flow path unit 4. The plurality of actuator units 21 are bonded onto an upper surface of the flow path unit 4. The flow path unit 4 and actuator units 21 are formed in such a manner that a plurality of thin plate members are laminated and bonded to one another. Flexible printed circuit boards (hereinafter referred to as FPCs) 50 which are feeder circuit members are bonded onto an upper surface of the actuator units 21 and pulled out in left and right direction. The FPCs 50 are led upward while bent as shown in FIG. 2. The base block 71 is made of a metal material such as stainless steel. Each of the ink reservoirs 3 in the base block 71 is a nearly rectangular parallelepiped hollow region formed along a direction of the length of the base block 71.

A lower surface 73 of the base block 71 protrudes downward from its surroundings in neighbors of openings 3*b*. The base block 71 touches the flow path unit 4 only at neighbors 73*a* of the openings 3*b* of the lower surface 73. For this reason, all other regions than the neighbors 73*a* of the openings 3*b* of the lower surface 73 of the base block 71 are isolated from the head body 70 so that the actuator units 21 are disposed in the isolated portions.

The base block 71 is bonded and fixed into a cavity formed in a lower surface of a grip 72*a* of a holder 72. The holder 72 includes a grip 72*a*, and a pair of flat plate-like protrusions 72*b* extending from an upper surface of the grip 72*a* in a direction perpendicular to the upper surface of the grip 72*a* so as to form a predetermined distance between each other. The FPCs 50 bonded to the actuator units 21 are disposed so as to go a long surfaces of the protrusions 72*b* of the holder 72 through elastic members 83 such as sponge respectively. Driver ICs 80 are disposed on the FPCs 50 disposed on the surfaces of the protrusions 72*b* of the holder 72. The FPCs 50 are electrically connected to the driver ICs 80 and the actuator units 21 by soldering so that drive signals output from the driver ICs 80 are transmitted to the actuator units 21 of the head body 70.

Nearly rectangular parallelepiped heat sinks 82 are disposed closely on outer surfaces of the driver ICs 80, so that heat generated in the driver ICS 80 can be radiated efficiently. Boards 81 are disposed above the driver ICs 80 and the heat sinks 82 and outside the FPCs 50. Seal members 84 are disposed between an upper surface of each heat sink 82 and a corresponding board 81 and between a lower surface of each heat sink 82 and a corresponding FPC 50 respectively. That is, the heat sinks 82, the boards 81 and the FPCs 50 are bonded to one another by the seal members 84.

Figure 4:
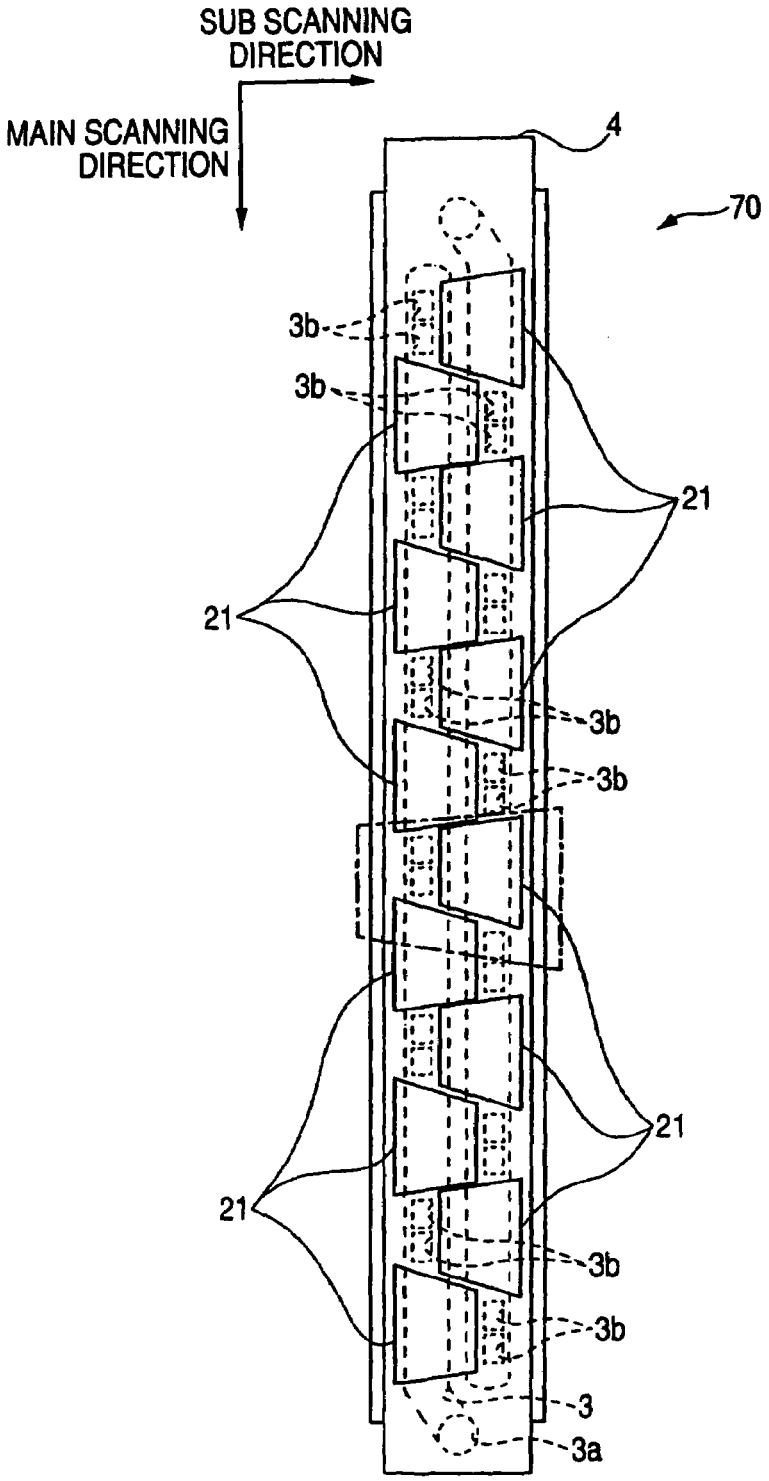
FIG. 4 is a plan view of a head body of the inkjet printing head depicted in FIG. 3.

FIG. 4 is a plan view of the head body included in the inkjet printing head depicted in FIG. 2. In FIG. 4, the ink reservoirs 3 formed in the base block 71 are drawn virtually by the broken 3 line. Two ink reservoirs 3 extend in parallel to each other along a direction of the length of the head body 70 so as to form a predetermined distance between the two ink reservoirs 3. Each of the two ink reservoirs 3 has an opening 3*a* at its one end. The two ink reservoirs 3 communicate with an ink tank (not shown) through the openings 3*a* so as to be always filled with ink. A large number of openings 3*b* are provided in each ink reservoir 3 along the direction of the length of the head body 70. As described above, the ink reservoirs 3 are connected to the flow path unit 4 by the openings 3*b*. The large number of openings 3*b* are formed in such a manner that each pair of openings 3*b* are disposed closely along the direction of the length of the head body 70. The pairs of openings 3*b* connected to one ink reservoir 3 and the pairs of openings 3*b* connected to the other ink reservoir 3 are arranged in staggered layout.

The plurality of actuator units 21 each having a trapezoid flat shape are disposed in regions where the openings 3*b* are not provided. The plurality of actuator units 21 are arranged in staggered layout so as to have a pattern reverse to that of the pairs of openings 3*b*. Parallel opposed sides (upper and lower sides) of each actuator unit 21 are parallel to the direction of the length of the head body 70. Inclined sides of adjacent actuator units 21 partially overlap each other in a direction of the width of the head body 70.

Figure 5:
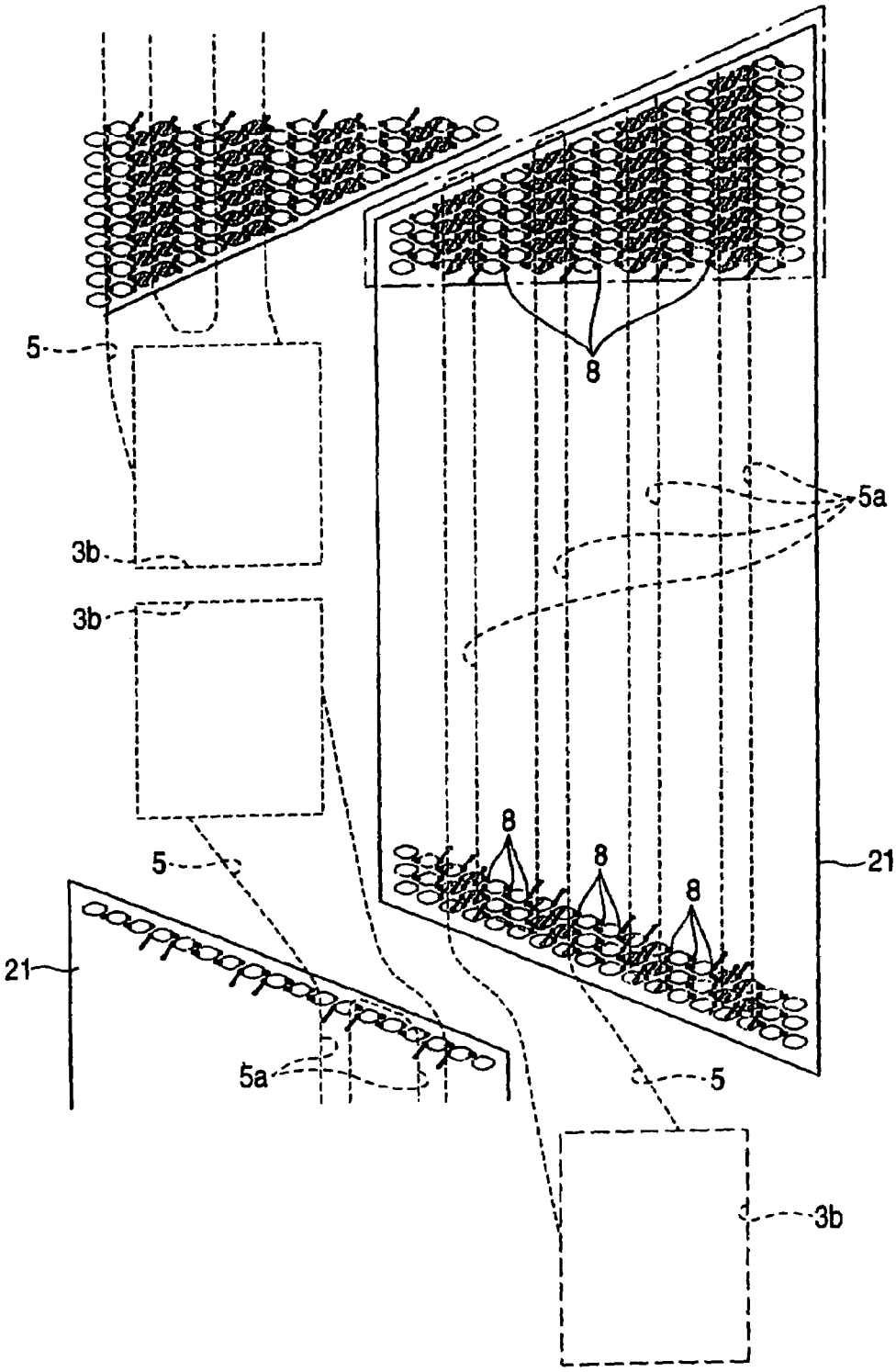
FIG. 5 is an enlarged view of a region surrounded by the chain line in FIG. 4.

FIG. 5 is an enlarged view of a region surrounded by the chain line in FIG. 4. As shown in FIG. 5, the openings 3*b* provided in each ink reservoir 3 communicate with manifolds 5 which are common ink chambers respectively. An end portion of each manifold 5 branches into two sub manifolds 5*a*. In plan view, every two sub manifolds 5*a* are separated from adjacent openings 3*b* extend from two inclined sides of each actuator unit 21. That is, four sub manifolds 5*a* in total are provided below each actuator unit 21 and extend along the parallel opposed sides of the actuator unit 21 so as to be separated from one another.

Ink ejection regions are formed in a lower surface of the flow path unit 4 corresponding to the bonding regions of the actuator units 21. As will be described later, a large number of nozzles 8 are disposed in the form of a matrix in a surface of each ink ejection region. Although FIG. 5 shows several nozzles 8 for the sake of simplification, nozzles 8 are actually arranged on the whole of the ink ejection region.

Figure 6:
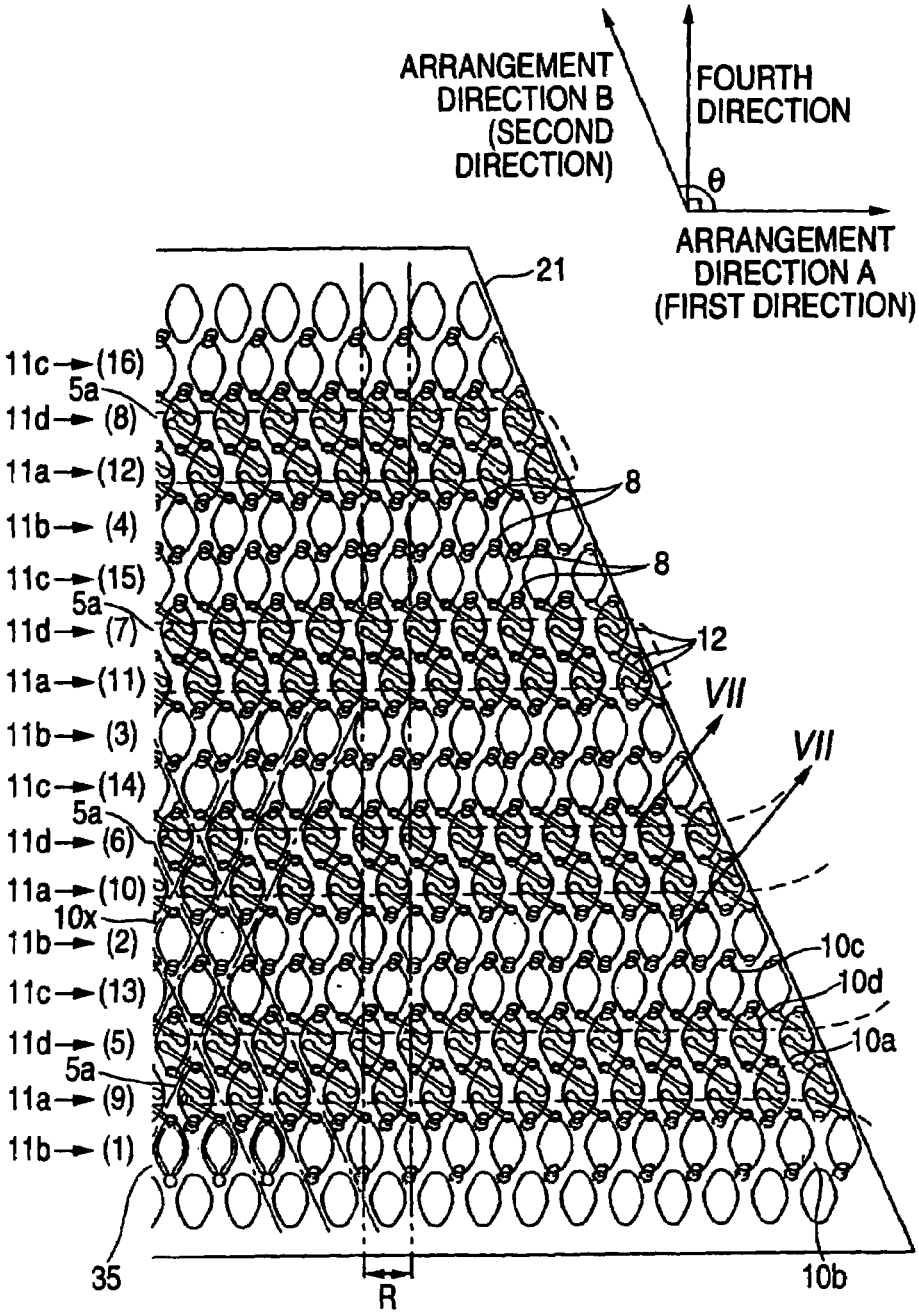
FIG. 6 is an enlarged view of a region surrounded by the chain line in FIG. 5.

FIG. 6 is an enlarged view of a region surrounded by the chain line in FIG. 5. FIGS. 5 and 6 show a state in which a plane of a large number of pressure chambers 10 disposed in the form of a matrix in the flow path unit 4 is viewed from a direction perpendicular to the ink ejection surface. Each of the pressure chambers 10 is shaped substantially like a rhomboid having rounded corners in plan view. The long diagonal line of the rhomboid is parallel to the direction of the width of the flow path unit 4. Each pressure chamber 10 has one end connected to a corresponding nozzle 8, and the other end connected to a corresponding sub manifold 5*a* as a common ink flow path through an aperture 12 (see FIG. 7). An individual electrode 35 having a planar shape similar to but size smaller than that of each pressure chamber 10 is formed on the actuator unit 21 so as to be adjacent to the pressure chamber 10 in plan view. Some of a large number of individual electrodes 35 are shown in FIG. 6 for the sake of simplification. Incidentally, the pressure chambers 10 and apertures 12 that must be expressed by the broken line in the actuator units 21 or in the flow path unit 4 are expressed by the solid line in FIGS. 5 and 6 to make it easy to understand the drawings.

In FIG. 6, a plurality of virtual rhombic regions 10 in which the pressure chambers 10 are stored respectively are disposed adjacently in the form of a matrix both in an arrangement direction A (first direction) and in an arrangement direction B (second direction) so that adjacent virtual rhombic regions 10*x* have common sides not overlapping each other. The arrangement direction A is a direction of the length of the inkjet printing head 1, that is, a direction of extension of each sub manifold 5*a*. The arrangement direction A is parallel to the short diagonal line of each rhombic region 10*x*. The arrangement direction B is a direction of one inclined side of each rhombic region 10*x* in which an obtuse angle θ is formed between the arrangement direction B and the arrangement direction A. The central position of each pressure chamber 10 is common to that of a corresponding rhombic region 10*x* but the contour line of each pressure chamber 10 is separated from that of a corresponding rhombic region 10*x* in plan view.

The pressure chambers 16 disposed adjacently in the form of a matrix in the two arrangement directions A and B are formed at intervals of a distance corresponding to 37.5 dpi along the arrangement direction A. The pressure chambers 10 are formed so that eighteen pressure chambers 10 are arranged in the arrangement direction B in one ink ejection region. Pressure chambers located at opposite ends in the arrangement direction B are dummy chambers that do not contribute to ink ejection.

The plurality of pressure chambers 10 disposed in the form of a matrix form a plurality of pressure chamber columns along the arrangement direction A shown in FIG. 5. The pressure chamber columns are separated into first pressure chamber columns 11*a*, second pressure chamber columns 11*b*, third pressure chamber columns 11*c* and fourth pressure chamber columns 11*d* in accordance with positions relative to the sub manifolds 5*a* viewed from a direction (third direction) perpendicular to the paper surface of FIG. 5. The first to fourth pressure chamber columns 11*a* to 11*d* are arranged cyclically in order of 11*c*->11*d*->11*a*->11*b*->11*c*->11*d*->. . . ->11*b* from an upper side to a lower side of each actuator unit 21.

In pressure chambers 10*a* forming the first pressure chamber column 11*a* and pressure chambers 10*b* forming the second pressure chamber column 11*b*, nozzles 8 are unevenly distributed on a lower side of the paper surface of FIG. 6 in a direction (fourth direction) perpendicular to the arrangement direction A when viewed from the third direction. The nozzles 8 are located in lower end portions of corresponding rhombic regions 10*x* respectively. On the other hand, in pressure chambers 10*c* forming the third pressure chamber column 11*c* and pressure chambers 10*d* forming the fourth pressure chamber column 11*d*, nozzles 8 are unevenly distributed on an upper side of the paper surface of FIG. 6 in the fourth direction. The nozzles 8 are located in upper end portions of corresponding rhombic regions 10*x* respectively. In the first and fourth pressure chamber columns 11*a* and 11*d*, regions not smaller than half of the pressure chambers 10*a* and 10*d* overlap the sub manifolds 5*a* when viewed from the third direction. In the second and third pressure chamber columns 11*b* and 11*c*, the regions of the pressure chambers 10*b* and 10*c* do not overlap the sub manifolds 5*a* at all when viewed from the third direction. For this reason, pressure chambers 10 belonging to any pressure chamber column can be formed so that the sub manifolds 5*a* are widened as sufficiently as possible while nozzles 8 connected to the pressure chambers 10 do not overlap the sub manifold 5*a*. Accordingly, ink can be supplied to the respective pressure chambers 10 smoothly.

Figure 7:
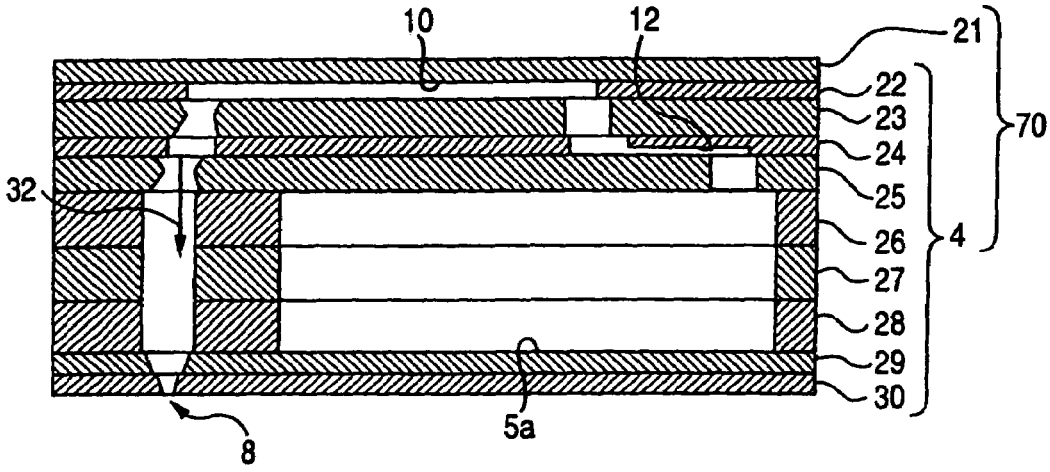
FIG. 7 is a sectional view taken along the line VII-VII in FIG. 6 for showing the head body depicted in FIG. 3.

Next, the sectional structure of the head body 70 will be further described with reference to FIGS. 7 and 8. FIG. 7 is a sectional view taken along the line VII-VII in FIG. 6. FIG. 7 shows a pressure chamber 10*a* belonging to the first pressure chamber column 11*a*. As is obvious from FIG. 7, each nozzle 8 is connected to a sub manifold 5*a* through the pressure chamber 10*a* and an aperture 12. In this manner, an individual ink flow path extending from an outlet of the sub manifold 5*a* to the nozzle 8 through the aperture 12 and the pressure chamber 10 is formed in the head body 70 in accordance with the pressure chamber 10.

As is obvious from FIG. 7, the pressure chamber 10 and the aperture 12 are provided in different levels. Accordingly, as shown in FIG. 6, in the flow path unit 4 corresponding to the ink ejection region below the actuator unit 21, an aperture 12 connected to one pressure chamber 10 can be disposed so as to overlap the position of a pressure chamber 10 adjacent to the pressure chamber in plan view. As a result, the pressure chambers 10 adhere to each other so as to be arranged densely. Accordingly, printing of a high-resolution image can be achieved by the inkjet printing head 1 having a relatively small required area.

Figure 8:
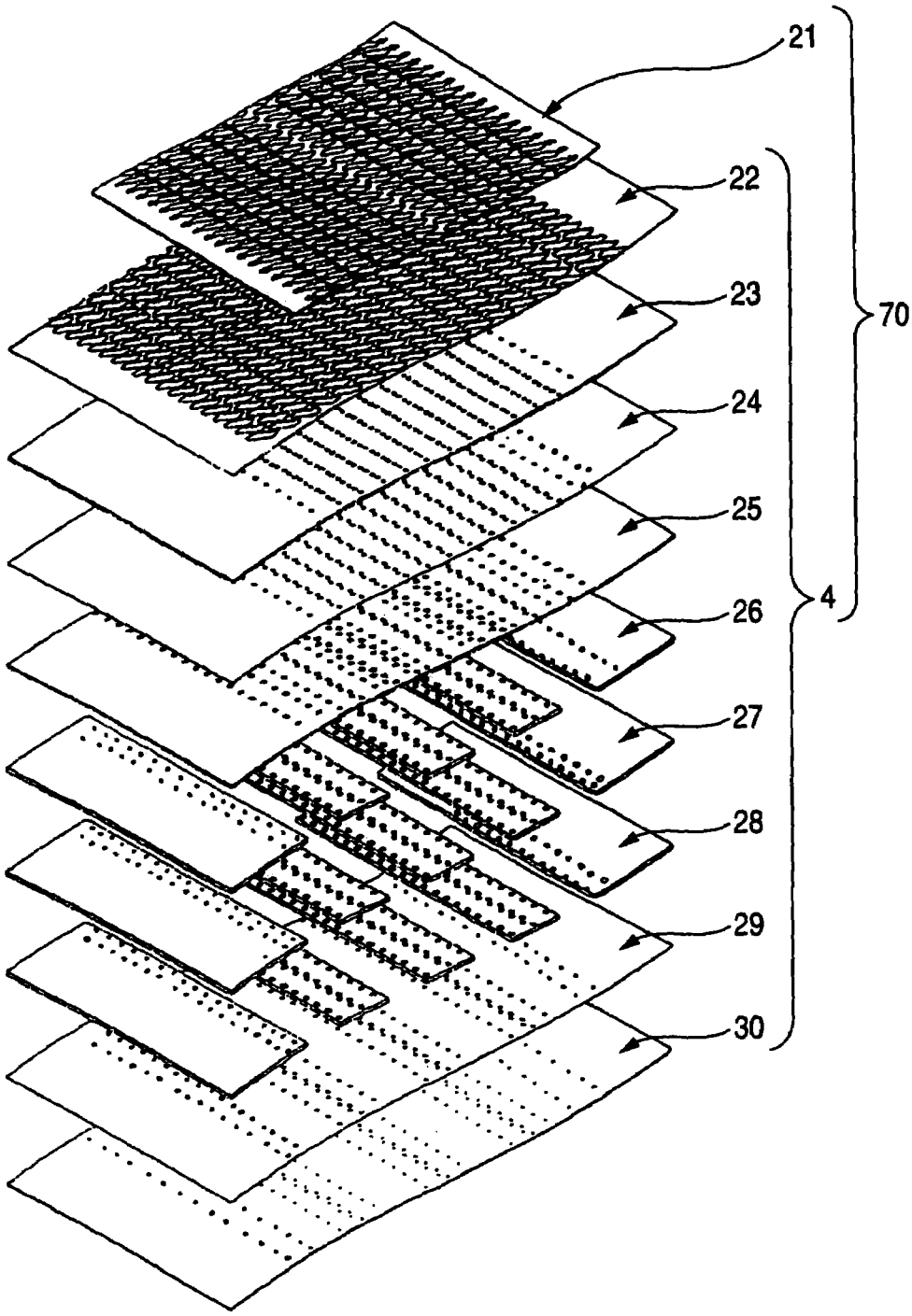
FIG. 8 is a partially exploded perspective view of the head body depicted in FIG. 7.

As is obvious also from FIG. 8, the head body 70 has a laminated structure in which ten sheet materials in total are laminated, that is, an actuator unit 21, a cavity unit 22, a base plate 23, an aperture plate 24, a supply plate 25, manifold plates 26, 27 and 28, a cover plate 29 and a nozzle plate 30 are laminated successively in descending order. The ten sheet materials except the actuator unit 21, that is, nine plates form a flow path unit 4.

As will be described later in detail, the actuator unit 21 includes a laminate of four piezoelectric sheets 41 to 44 (see FIG. 11) as four layers, and electrodes disposed so that only the uppermost layer is provided as a layer having a portion serving as an active layer at the time of application of electric field (hereinafter referred to as "active layer-including layer") while the residual three layers are provided as non-active layers. The cavity plate 22 is a metal plate having a large number of approximately rhomboid openings corresponding to the pressure chambers 10. The base plate 23 is a metal plate which has openings each for connecting one pressure chamber 10 of the cavity plate 22 to a corresponding aperture 12, and openings each for connecting the pressure chamber 10 to a corresponding nozzle 8. The aperture plate 24 is a metal plate which has apertures 12, and openings 12*d* each for connecting one pressure chamber 10 of the cavity plate 22 to a corresponding nozzle 8. Each of the apertures 12 has an ink inlet 12*a* on the sub manifold 5*a* side, an ink outlet 12*b* on the pressure chamber 10 side, and a communication portion 12*c* formed slimly while connected to the ink inlet and outlet 12*a* and 12*b*. The supply plate 25 is a metal plate which has openings each for connecting an aperture 12 for one pressure chamber 10 of the cavity plate 22 to a corresponding sub manifold 5*a*, and openings each for connecting the pressure chamber 10 to the nozzle 8. The manifold plates 26, 27 and 28 are metal plates which have the sub manifolds 5*a*, and openings each for connecting one pressure chamber 10 of the cavity plate 22 to a corresponding nozzle 8. The cover plate 29 is a metal plate which has openings each for connecting one pressure chamber 10 of the cavity plate 22 to a corresponding nozzle 8. The nozzle plate 30 is a metal plate which has nozzles 8 each provided for one pressure chamber 10 of the cavity plate 22.

The ten sheets 21 to 30 are laminated while positioned so that individual ink flow paths 32 are formed as shown in FIG. 7. Each individual ink flow path 32 first goes upward from the sub manifold 5*a*, extends horizontally in the aperture 12, goes further upward from the aperture 12, extends horizontally again in the pressure chamber 10, momentarily goes obliquely downward in the direction of departing from the aperture 12 and goes vertically downward to the nozzle 8.

Figure 9:
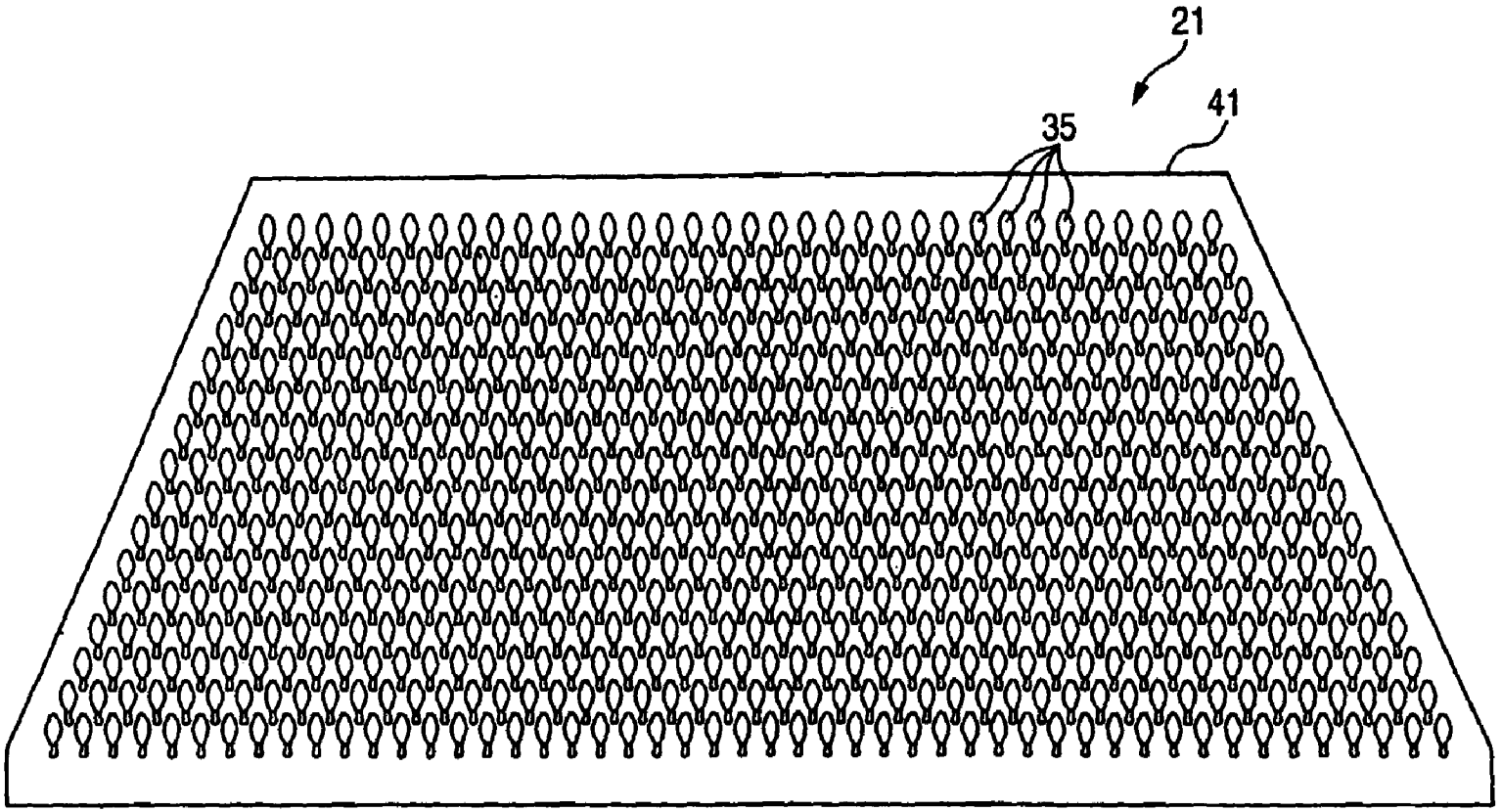
FIG. 9 is a plan view of an actuator unit depicted in FIG. 7.

Next, the configuration of the actuator unit 21 will be described. FIG. 9 is a plan view of the actuator unit 21. On the actuator unit 21, a large number of individual electrodes 35 are arranged in a form of a matrix so as to have the same pattern as that of the pressure chambers 10. The individual electrodes 35 are arranged in positions opposite to the pressure chambers 10 respectively in plan view. According to the configuration in which arranging the individual electrodes 35 in a form of a matrix, each of ink discharging units including the pressure chamber 10 and the individual electrode 25 becomes arranged in a form of axisymmetrical. As a result, a crosstalk between each of the ink discharging units becomes uniform in the inkjet printing head 1.

Figure 10:
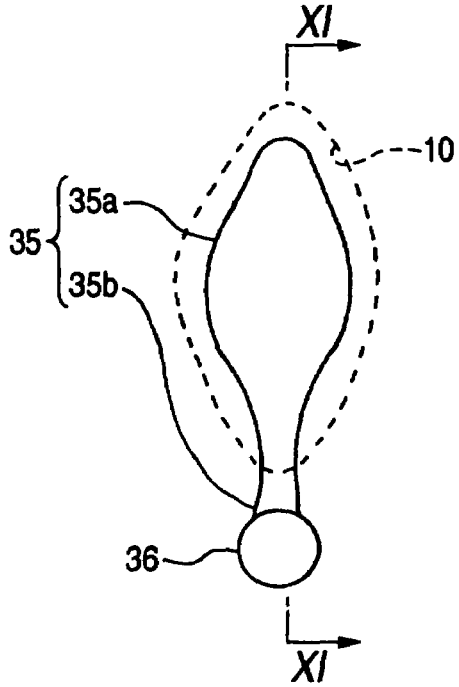
FIG. 10 is a plan view of each individual electrode formed on the actuator unit depicted in FIG. 7.

FIG. 10 is a plan view of each individual electrode 35. As shown in FIG. 10, each individual electrode 35 has a main electrode region 35*a* disposed in a position opposite to a corresponding pressure chamber 10 and received in the pressure chamber 10 in plan view, and a subsidiary electrode region 35*b* connected to the main electrode region 35*a* and disposed in a position opposite to the outside of the pressure chamber 10. In other words, each of the main electrode region 35*a* is disposed at a region corresponding to a region where the pressure chamber 10 is provided, and the subsidiary electrode region 35*b* is a part of the individual electrode 35 in which provided in protruded manner from the main electrode region 35*a*.

Figure 11:
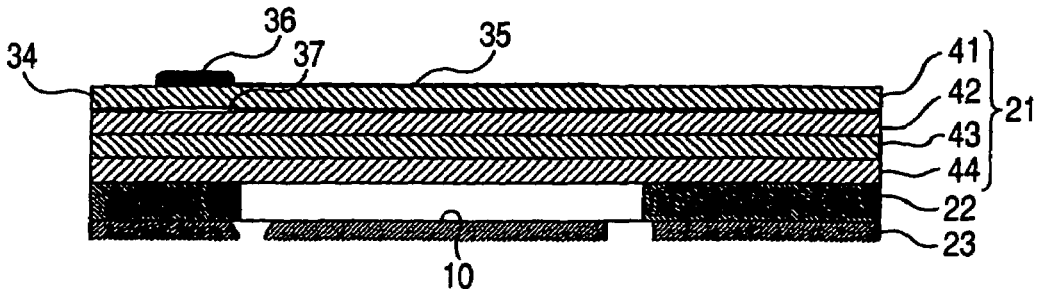
FIG. 11 is a sectional view taken along the line XI-XI in FIG. 10.

FIG. 11 is a sectional view taken along the line XI-XI in FIG. 10. As shown in FIG. 11, the actuator unit 21 includes four piezoelectric sheets 41, 42, 43 and 44 which are formed to have an equal thickness of about 15 μm. The piezoelectric sheets 41 to 44 are provided as stratified flat plates (continuous flat plate layers) which are continued to one another so as to be arranged over a large number of pressure chambers 10 formed in one ink ejection region in the head body 70. Because the piezoelectric sheets 41 to 44 are arranged as continuous flat plate layers over the large number of pressure chambers 10, the individual electrodes 35 can be disposed densely on the piezoelectric sheet 41: when, for example, a screen printing technique is used. Accordingly, the pressure chambers 10 formed in positions opposite to the individual electrodes 35 can be also disposed densely, so that a high resolution image can be printed. Each of the piezoelectric sheets 41 to 44 is made of a ceramic material of the lead zirconate titanate (PZT) type having ferroelectricity.

As shown in FIG. 10, the main electrode region 35*a* of the individual electrode 35 formed on the piezoelectric sheet 41 as the uppermost layer has a nearly rhombic shape approximately similar to that of the pressure chamber 10 in plan view. A lower acute-angled portion of the nearly rhombic main electrode region 35*a* extends to be connected to the subsidiary electrode region 35*b* opposite to the outside of the pressure chamber 10. A circular land portion 36 electrically connected to the individual electrode 35 is provided at an end of the subsidiary electrode region 35*b*. As shown in FIG. 11, the land portion 36 faces a region of the cavity plate 22 in which the pressure chamber 10 is not formed. For example, the land portion 36 is made of gold containing glass frit. As shown in FIG. 10, the land portion 36 is bonded onto a surface of the extension portion of the subsidiary electrode region 35*b*. Although an FPC 50 is not shown in FIG. 11, the land portion 36 is electrically connected to a contact point provided on the FPC 50. To perform this connection, the contact point on the FPC 50 needs to be pressed against the land portion 36. Because there is no pressure chamber 10 formed in the region of the cavity plate 22 opposite to the land portion 36, sure connection can be made by sufficient pressing.

Figure 12A:
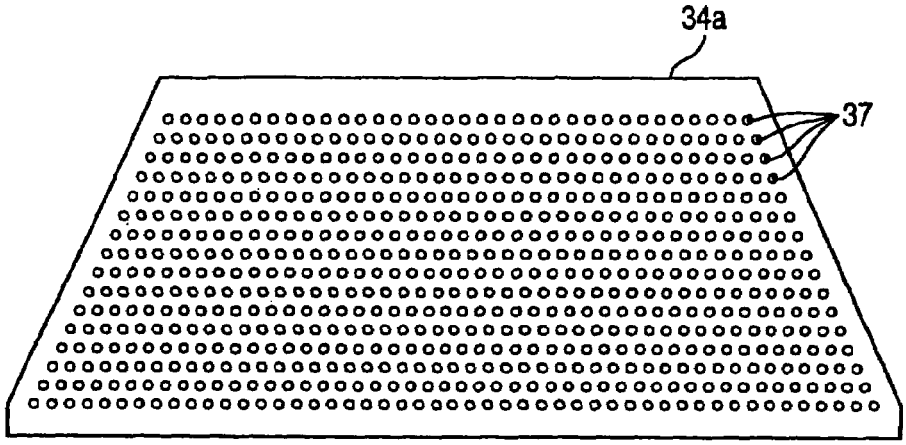
FIG. 12A is a plan view of a common electrode formed in the actuator unit depicted in FIG. 7.
Figure 12B:
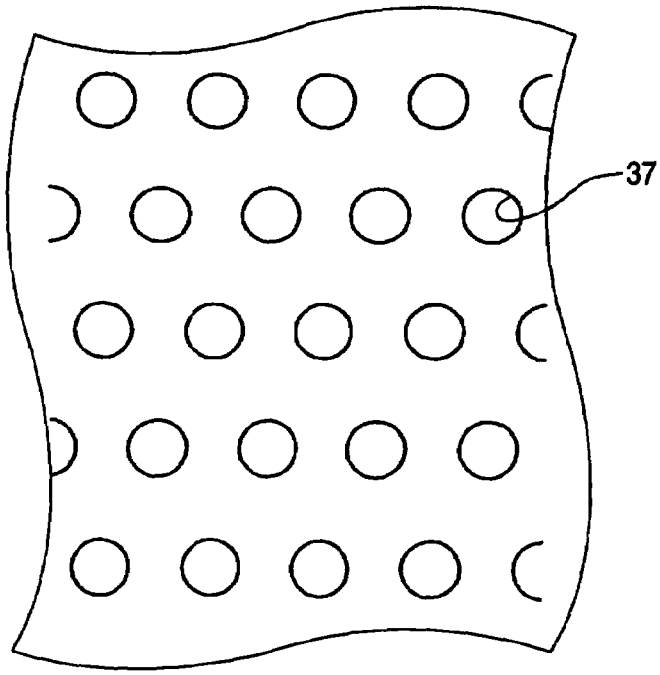
FIG. 12B is an enlarged view showing part of the common electrode.

A common electrode 34 having the same outer shape as that of the piezoelectric sheet 41 and having a thickness of about 2 μm is interposed between the piezoelectric sheet 41 as the uppermost layer and the piezoelectric sheet 42 located under the piezoelectric sheet 41. FIG. 12A is a plan view of the common electrode 34. FIG. 12B is an enlarged view showing part of the common electrode 34. As is obvious from FIGS. 12A and 12B, a large number of circular openings 37 opposite to the land portions 36 and slightly larger in diameter than the land portions 36 are formed in the common electrode 34 so as to have the same pattern as that of the individual electrodes 35. Each opening 37 is an opening formed in the common electrode 34. The individual electrodes 35 and the common electrode 34 are made of a metal material such as Ag—Pd.

The common electrode 34 is grounded to a region not shown. Accordingly, the common electrode 34 is kept at ground potential equally in regions corresponding to all the pressure chambers 10. The individual electrodes 35 are connected to the driver IC 80 through the FPC 50 including independent lead wires in accordance with the individual electrodes 35 and through the land portions 36 so that electric potential can be controlled in accordance with each pressure chamber 10 (see FIGS. 2 and 3).

Figure 13A:
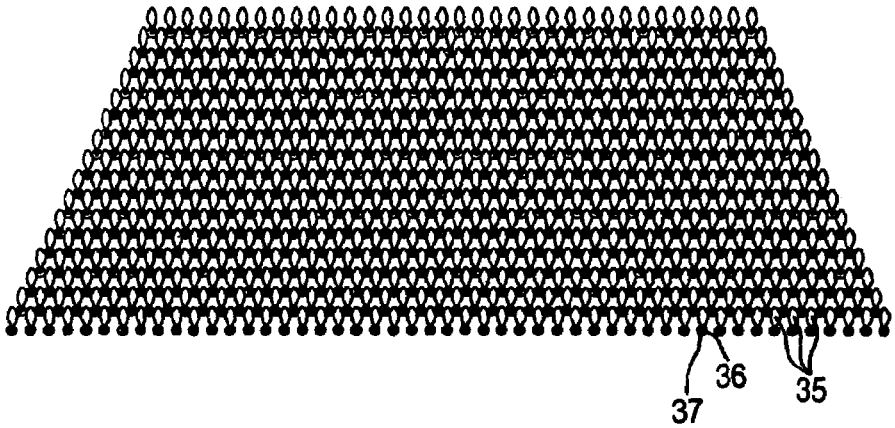
FIG. 13A is a virtual plan view showing a state in which a pattern of individual electrodes and a pattern of the common electrode overlap each other in the actuator unit depicted in FIG. 7.
Figure 13B:
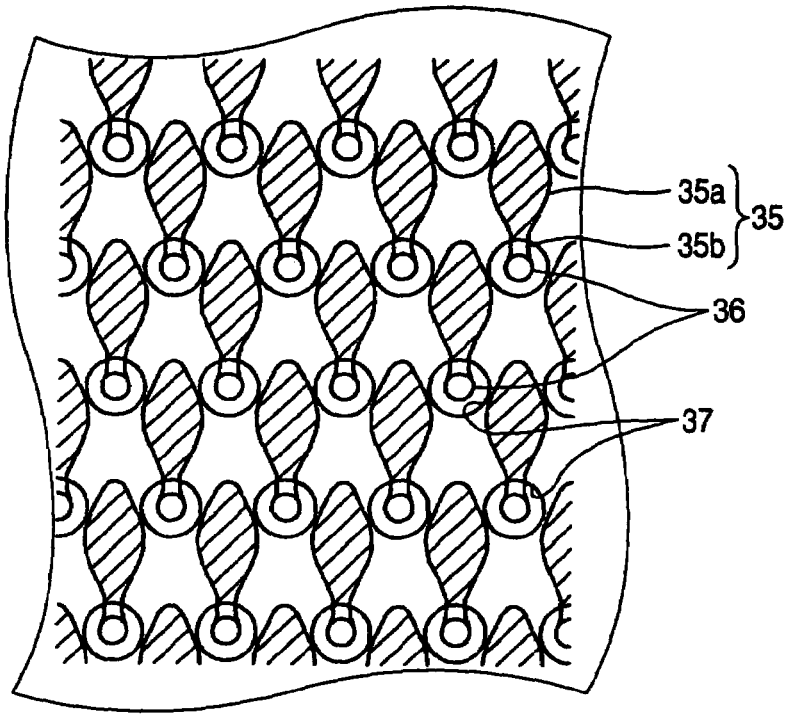
FIG. 13B is an enlarged view showing part of FIG. 13A.

FIG. 13A is a virtual plan view showing a state in which the pattern of the individual electrodes 35 and the pattern of the common electrode 34 overlap each other. FIG. 13B is an enlarged view showing part of FIG. 13A. In FIG. 13B, the regions of overlap of the individual electrodes 35 and the common electrode 34 are shown as hatched portions. As is obvious from FIG. 13B, in the first embodiment, almost all of the subsidiary electrode regions 35*b* are located in the openings 37 formed in the common electrode 34 while almost all of the main electrode regions 35*a* overlap the common electrode 34.

Next, a drive method of the actuator unit 21 will be described. The direction of polarization of the piezoelectric sheet 41 in the actuator unit 21 is a direction of the thickness of the piezoelectric sheet 41. That is, the actuator unit 21 has a so-called unimorph type structure in which one piezoelectric sheet 41 on an upper side (i.e., far from the pressure chambers 10) is used as a layer including an active layer while three piezoelectric sheets 42 to 44 on a lower side (i.e., near to the pressure chambers 10) are used as non-active layers. Accordingly, when the electric potential of an individual electrode 35 is set at a predetermined positive or negative value, an electric field applied portion of the piezoelectric sheet 41 put between electrodes serves as an active layer (pressure generation portion) and shrinks in a direction perpendicular to the direction of polarization by the transverse piezoelectric effect.

In the first embodiment, portions of the piezoelectric sheet 41 put between the main electrode regions 35*a* and the common electrode 34 serve as active layers because electric field is applied on the portions. On the other hand, portions of the piezoelectric sheet 41 below the subsidiary electrode regions 35*b* little serve as active layers because the openings 37 are provided in the common electrode 34 so that electric field intensity is reduced greatly. Accordingly, only the portions of the piezoelectric sheet 41 put between the main electrode regions 35*a* and the common electrode 34 shrink in a direction perpendicular to the direction of polarization by the transverse piezoelectric effect.

On the other hand, the piezoelectric sheets 42 to 44 are not displaced spontaneously because they are not affected by electric field. Accordingly, a difference in distortion in a direction perpendicular to the direction of polarization is generated between the piezoelectric sheet 41 as the upper layer and each of the piezoelectric sheets 42 to 44 as the lower layer. As a result, the whole of the piezoelectric sheets 41 to 44 is to be deformed so as to be curved convexly on the non-active side (unimorph deformation). On this occasion, as shown in FIG. 11, the lower surface of the whole of the piezoelectric sheets 41 to 44 is fixed to the upper surface of the partition wall (cavity plate) 22 for partition into the pressure chambers. Consequently, the piezoelectric sheets 41 to 44 are deformed so as to be curved convexly on the pressure chamber side. For this reason, the volume of each pressure chamber 10 is reduced to increase the pressure of ink to thereby eject ink from a corresponding nozzle 8. When the electric potential of each individual electrode 35 is then returned to the same potential as that of the common electrode 34, ink is sucked into the pressure chamber 10 from the manifold 5 side because the piezoelectric sheets 41 to 44 are restored to the original shape to return the volume of the pressure chamber 10 to the original value.

As described above, in the first embodiment, the common electrode 34 is not provided on the whole region of the actuator unit 21 but the openings 37 are provided to form openings in the common electrode 34. Because the openings 37 are provided in portions opposite to the subsidiary electrode regions 35*b* of the individual electrodes 35, portions of the piezoelectric sheet 41 opposite to the subsidiary electrode regions 35*b* little serve as active layers even in the case where the electric potential of each individual electrode 35 is set to be different from the electric potential of the common electrode 34. For this reason, the amount of deformation of the piezoelectric sheets 41 to 44 in the openings 37 and their vicinity becomes smaller than that in the case where the openings 37 are not formed in the common electrode 34.

Incidentally, another drive method may be used as follows. That is, the electric potential of each individual electrode 35 is set to be different from the electric potential of the common electrode 34 in advance. Whenever there is an ejection request, the electric potential of the individual electrode 35 is once changed to the same electric potential as that of the common electrode 34. Then, the electric potential of the individual is electrode 35 is restored to the original value different from the electric potential of the common electrode 34 at predetermined timing. In this case, because the piezoelectric sheets 41 to 44 are restored to the original shape at the timing when the electric potential of the individual electrode 35 is changed to the same value as the electric potential of the common electrode 34, the volume of the pressure chamber 10 is increased compared with the initial state (in which the individual electrode 35 and the common electrode 34 are different in electric potential from each other). In this manner, ink is sucked into the pressure chamber 10 from the manifold 5 side. Then, the piezoelectric sheets 41 to 44 are deformed so as to be curved convexly on the pressure chamber 10 side at the timing when the electric potential of the individual electrode 35 is restored to the original value different from the electric potential of the common electrode 34. As a result, the volume of the pressure chamber 10 is reduced to increase the pressure of ink to thereby eject ink. Also in the case where the drive method is used, the openings 37 are formed in the common electrode 34. Accordingly, the amount of deformation of the piezoelectric sheets 41 to 44 in the openings 37 and their vicinity becomes smaller than that in the case where the openings 37 are not formed in the common electrode 34.

Referring back to FIG. 6, a zonal region R having a width (678.0 μm) corresponding to 37.5 dpi in the arrangement direction A and extending in the arrangement direction B will be considered. Only one nozzle 8 is present in any one of sixteen pressure chamber columns 11*a* to 11*d* in the zonal region R. That is, when such a zonal region. R is formed in an optional position of the ink ejection region corresponding to one actuator unit 21, sixteen nozzles 8 are always distributed in the zonal region R. The positions of points obtained by projecting the sixteen nozzles 8 onto a line extending in the arrangement direction A are arranged at intervals of a distance corresponding to 600 dpi which is resolution at the time of printing.

When the sixteen nozzles 8 belonging to one zonal region R are numbered as (1) to (16) in rightward order of the positions of points obtained by projecting the sixteen nozzles 8 onto a line extending in the arrangement direction A, the sixteen nozzles 8 are arranged in ascending order of (1), (9), (5), (13), (2), (10), (6), (14), (3), (11), (7), (15), (4), (12), (8) and (16). When the inkjet printing head 1 configured as described above is driven suitably in accordance with conveyance of a printing medium in the actuator unit 21, characters, graphics, etc. having resolution of 600 dpi can be drawn.

For example, description will be made on the case where a line extending in the arrangement direction A is printed with resolution of 600 dpi. First, brief description will be made on the case of a reference example in which each nozzle 8 is connected to the acute-angled portion on the same side of the pressure chamber 10. In this case, a nozzle 8 in the pressure chamber column located in the lowermost position in FIG. 6 begins to eject ink in accordance with conveyance of the printing medium. Nozzles 8 belonging to adjacent pressure chamber columns on the upper aide are selected successively to eject ink. Accordingly, dots of ink are formed so as to be adjacent to one another at intervals of a distance corresponding to. 600 dpi in the arrangement direction A. Finally, a line extending in the arrangement direction A is drawn with resolution of 600 dpi as a whole.

On the other hand, in the first embodiment, a nozzle 8 in the pressure chamber column 11*b* located in the lowermost position in FIG. 6 begins to eject ink. As the printing medium is conveyed, nozzles 8 connected to adjacent pressure chambers on the upper side are selected successively to eject ink. On this occasion, the displacement of the nozzle 8 position in the arrangement direction A in accordance with increase in position by one pressure chamber column from the lower side to the upper side is not constant. Accordingly, dots of ink formed successively along the arrangement direction A in accordance with conveyance of the printing medium are not arranged at regular intervals of 600 dpi.

That is, as shown in FIG. 6, ink is first ejected from the nozzle (1) connected to the pressure chamber column 11*b* located in the lowermost position in FIG. 5 in accordance with conveyance is of the printing medium. A row of dots are formed on the printing medium at intervals of a distance corresponding to 37.5 dpi. Then, when the line forming position reaches the position of the nozzle (9) connected to the second lowest pressure chamber column 11*a* as the printing medium is conveyed, ink is ejected from the nozzle (9). As a result, a second ink dot is formed in a position displaced by eight times as large as the distance corresponding to 600 dpi in the arrangement direction A from the initial dot position.

Then, when the line forming position reaches the position of the nozzle (5) connected to the third lowest pressure chamber column 11*d* as the printing medium is conveyed, ink is ejected from the nozzle (5). As a result, a third ink dot is formed in a position displaced by four times as large as the distance corresponding to 600 dpi in the arrangement direction A from the initial dot position. When the line forming position reaches the position of the nozzle (13) connected to the fourth lowest pressure chamber column 11*c* as the printing medium is further conveyed, ink is ejected from the nozzle (13). As a result, a fourth ink dot is formed in a position displaced by twelve times as large as the distance corresponding to 600 dpi in the arrangement direction A from the initial dot position. When the line forming position reaches the position of the nozzle (2) connected to the fifth lowest pressure chamber column 11*b* as the printing medium is further conveyed, ink is ejected from the nozzle (2). As a result, a fifth ink dot is formed in a position displaced by the distance corresponding to 600 dpi in the arrangement direction A from the initial dot position.

Then, ink dots are formed in the same manner as described above while nozzles 8 connected to the pressure chambers 10 are selected successively from the lower side to the upper side in FIG. 6. When N is the number of a nozzle 8 shown in FIG. 5 on this occasion, an ink dot is formed in a position displaced by a value corresponding to (the ratio n=N−1)×(the distance corresponding to 600 dpi) in the arrangement direction A from the initial dot position. Finally, when selection of the sixteen nozzles 8 is completed, fifteen dots formed at intervals of a distance corresponding to 600 dpi are interpolated in between ink dots formed at intervals of a distance corresponding to 37.5 dpi by the nozzle (1) in the lowest pressure chamber column 11*b* in FIG. 5. As a result, a line extending in the arrangement direction A can be drawn with resolution of 600 dpi as a whole.

Incidentally, printing with resolution of 600 dpi can be achieved when neighbors of opposite end portions of each ink ejection region (inclined sides of each actuator unit 21)

in the arrangement direction A are complementary to neighbors of opposite end portions of corresponding ink ejection regions in the arrangement direction A to other actuator unit 21 opposed to the actuator unit 21 in the direction of the width of the head body 70.

As described above, in the first embodiment, the common electrode 34 is not provided on the whole region of the actuator unit 21 but the openings 37 are provided to form openings in the common electrode 34. For this reason, portions of the piezoelectric sheet 41 opposite to the subsidiary electrode regions 35*b* of the individual electrodes 35 little serve as active layers, so that the amount of deformation of the piezoelectric sheets 41 to 44 in the openings 37 and their vicinity becomes smaller than that in the case where the openings 37 are not formed in the common electrode 34. Accordingly, when a nozzle connected to a certain pressure chamber 10 operates to eject ink, such crosstalk that ink ejection characteristic of a nozzle connected to a pressure chamber 10 adjacent to the certain pressure chamber 10 is worsened by vibration of the piezoelectric sheets 41 to 44 is reduced. Moreover, the openings 37 are formed in the common electrode 34 so as to be opposite to only portions of the piezoelectric sheet 41 not opposite to the main electrode regions 35*a* and little contributing to ink ejection. Accordingly, ink ejection characteristic can be retained because the amount of displacement of the piezoelectric sheets 41 to 44 opposite to the main electrode regions. 35*a* of the individual electrodes 35 is little changed on the basis of the provision of the openings 37. Moreover, the land portions 36 connected to contact points in the FPC 50 are provided in the subsidiary electrode regions 35*b* in which the amount of deformation of the piezoelectric sheets 41 to 44 is small. Accordingly, the possibility that the land portions 36 may be separated from the contact points of the FPC 50 in accordance with the actuation of the actuator unit 21 can be reduced.

In the first embodiment, the pressure chambers 10 and the individual electrodes 35 are arranged densely in the form of a matrix so that a land portion 36 connected to an individual electrode 35 on another column is located between the main electrode regions 35*a* of two individual electrodes 35 adjacent to each other along the arrangement direction A. That is, when viewed along the arrangement direction A, two main electrode regions 35*a* are provided on opposite sides of each land portion 36 while an opening 37 as an opening is provided in a portion of the common electrode 34 opposite to each land portion 36. For this reason, vibration as a cause of crosstalk is little transmitted to the two individual electrodes 35 adjacent to each other along the arrangement direction A because the portion of the common electrode 34 opposite to the land portion 36 does not serve as an active layer even in the case where a voltage is applied to the land portion 36 to perform an ink ejection operation. Accordingly, an excellent crosstalk reducing effect can be obtained also in the inkjet printing head according to the first embodiment.

In the first embodiment, almost all of the subsidiary electrode regions 35*b* are located in the circular openings 37 formed in the common electrode 34, so that the relation (the area of the openings)>(the area of the subsidiary electrode regions) holds. It is however possible to change the shape and size of each opening 37 if the change in shape and size has no adverse influence on deformation of the pressure chambers 10. For example, in a modified embodiment, openings nearly equal in shape to the subsidiary electrode regions 35*b* may be formed in the common electrode 34. In this case, the relation (the area of the openings)=(the area of the subsidiary electrode regions) holds, so that a crosstalk reducing effect equivalent to that of the first embodiment can be obtained. In another modified embodiment, openings smaller than the subsidiary electrode regions 35*b* may be formed in the common electrode 34. In this case, the relation (the area of the openings)<(the area of the subsidiary electrode regions) holds, so that the crosstalk reducing effect is lowered compared with that of the first embodiment. Further, the shape of each opening 37 may be provided as any other shape than the circular shape.

Next, a second embodiment of the invention will be described. The inkjet printing head according to the second embodiment is different from that according to the first embodiment in the shape of each opening formed in the common electrode. That is, the inkjet printing head according to the second embodiment is the same as that according to the first embodiment with respect to the structure shown in FIGS. 1 to 10 but is different from that according to the first embodiment with respect to the structure shown in FIGS. 11, 12A, 12B, 13A and 13B. Therefore, description will be made below mainly on the point of difference while members the same as those in the first embodiment are denoted by the same reference numerals as those in the first embodiment for the sake of omission of duplicated description.

Figure 14:
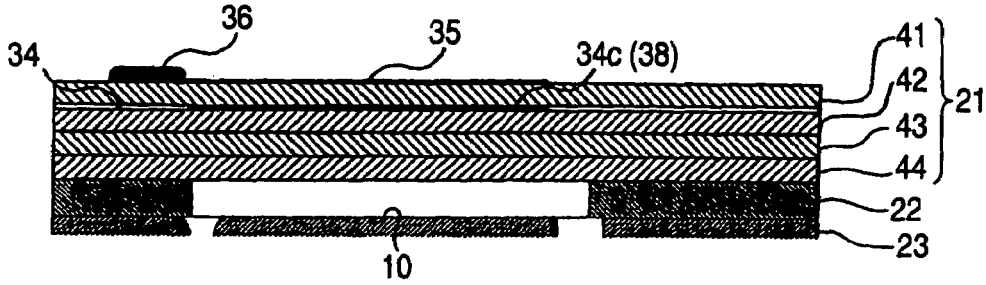
FIG. 14 is a sectional view corresponding to FIG. 11 and showing a head body in a second embodiment of the invention.
Figure 15A:
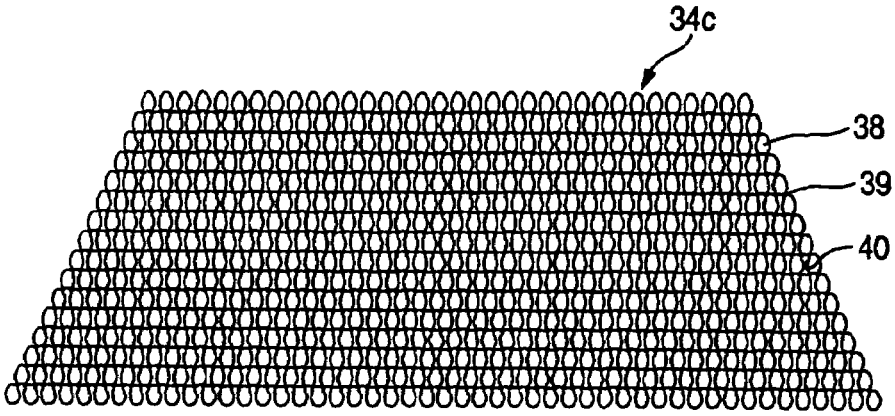
FIG. 15A is a plan view of the common electrode depicted in FIG. 14.
Figure 15B:
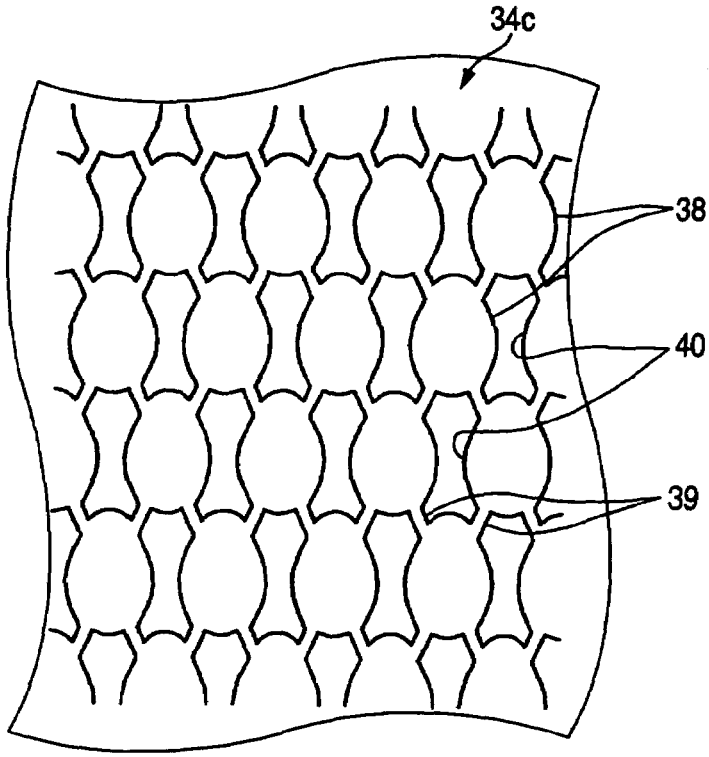
FIG. 15B is an enlarged view showing part of the common electrode.

FIG. 14 is a sectional view of a head body in the second embodiment. FIG. 14 corresponds to FIG. 11. As shown in FIG. 14, a common electrode 34*c* is interposed between the piezoelectric sheet 41 as the uppermost layer and the piezoelectric sheet 42 under the piezoelectric sheet 41. FIG. 15A is a plan view of the common electrode 34*c*. FIG. 15B is an enlarged view showing part of the common electrode 34*c*. As is obvious from FIGS. 15A and 15B, the common electrode 34*c* has such a shape that a large number of island portions 38 similar in shape to the main electrode regions 35*a* of the individual electrodes 35 but larger by a size than the main electrode regions 35*a* are connected to one another by bridges 39. The shape of the common electrode 34*c* as a whole is substantially equal to the shape of the actuator unit 21 in plan view. The bridges 39 are arranged so that four bridges are connected to the upper right, lower right, upper left and lower left of each island portion 38. Because the island portions 38 and the bridges 39 are connected in this manner, openings 40 are formed in the common electrode 34*c*, that is, openings in which neither island portion 38 nor bridge 39 is provided are formed in the common electrode 34*c*. Incidentally, because all the island portions 38 arranged opposite to the main electrode regions 35*a* of the individual electrodes 35 are electrically connected to one another by the bridges 39, the common electrode 34*c* is kept at the ground potential evenly in all regions corresponding to the pressure chambers 10.

Figure 16A:
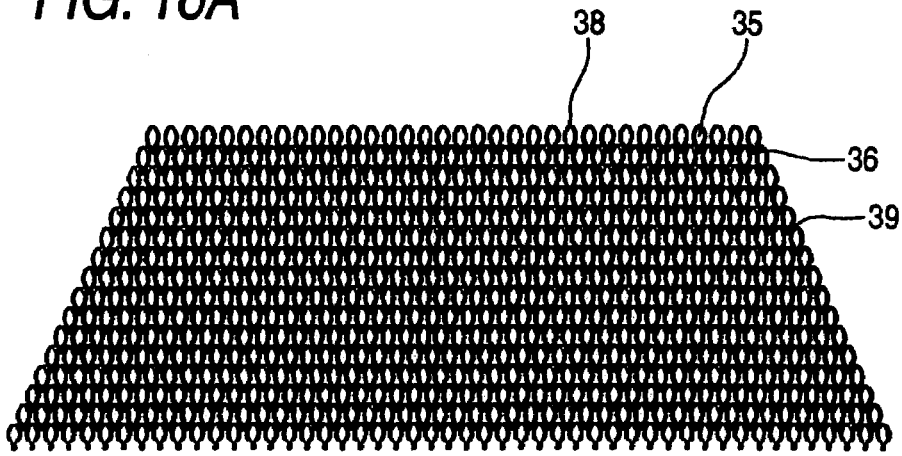
FIG. 16A is a virtual plan view showing a state in which a pattern of individual electrodes and a pattern of the common electrode overlap each other in the actuator unit depicted in FIG. 14.
Figure 16B:
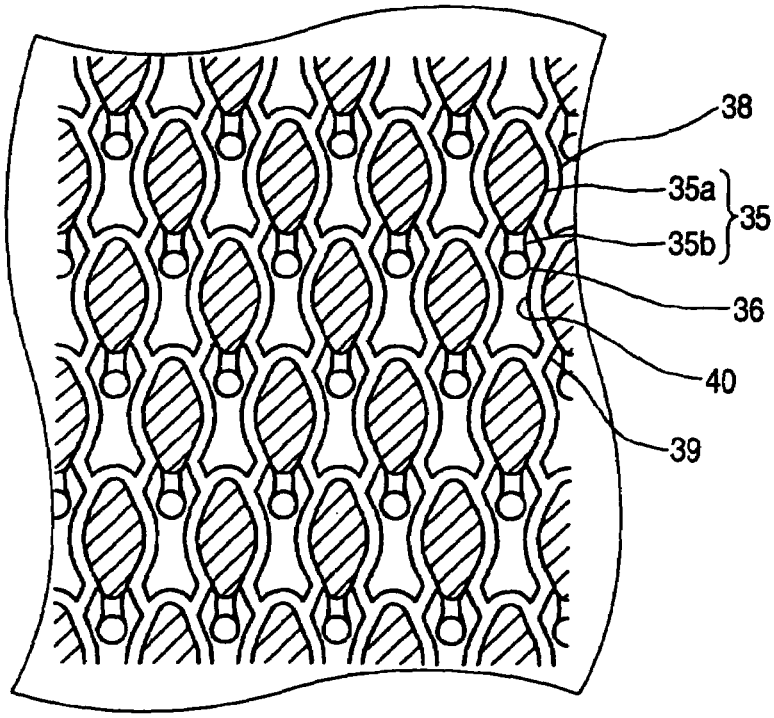
FIG. 16B is an enlarged view showing part of FIG. 16A.

FIG. 16A is a virtual plan view showing a state in which the pattern of the individual electrodes 35 and the pattern of the common electrode 34*c* overlap each other. FIG. 1 GB is an enlarged view showing part of FIG. 16A. In FIG. 16B, regions in which the individual electrodes 35 overlap the common electrode 34*c* are expressed as hatched portions. As is obvious from FIG. 16B, in the second embodiment, almost all of the subsidiary electrode regions 35*b* are located in the openings 40 formed in the common electrode 34*c* while almost all of the main electrode regions 35*a* overlap the island portions 38 of the common electrode 34*c*. Main electrode regions 35*a* adjacent to one another in the up/down and left/right directions are blocked by openings 40. When the inkjet printing head according to the second embodiment configured as described above is driven, portions of the piezoelectric sheet 411 put between the main electrode regions 35*a* and the island portions 38 of the common electrode 34*c* serve as active layers because electric field is applied on the portions. On the other hand, portions of the piezoelectric sheet 41 located under the subsidiary electrode regions 35*b* little serve as active layers because electric field intensity is reduced greatly due to the openings 40 provided in the common electrode 34*c*. Accordingly, only the portions of the piezoelectric sheet 41 put between the main electrode regions 35*a* and the island portions 38 of the common electrode 34*c* shrink in a direction perpendicular to the direction of polarization by the transverse piezoelectric effect Accordingly, the amount of deformation of the piezoelectric sheets 41 to 44 in the openings 40 and their vicinity becomes smaller than that in the case where the openings 40 are not formed in the common electrode 34*c*. Accordingly, though the piezoelectric sheets 41 to 44 vibrate when a nozzle connected to a certain pressure chamber 10 operates to eject ink, the influence of the vibration on ink ejection characteristic of a nozzle connected to a pressure chamber 10 adjacent to the certain pressure chamber 10 is suppressed so that crosstalk is reduced. Moreover, the openings 40 are formed in the common electrode 34*c* so as to be opposite to only the portions of the piezoelectric sheet 41 not opposite to the main electrode regions 35*a* and not contributing to ink ejection. Accordingly, ink ejection characteristic can be retained because the amount of displacement of the piezoelectric sheets 41 to 44 opposite to the main electrode regions 35*a* of the individual electrodes 35 is little changed by the provision of the openings 40.

As is also obvious from FIG. 16B, in the second embodiment, the common electrode 34*c* is formed so that the common electrode 34*c* is not separated by the openings 40 and that the openings 40 surround the main electrode regions 35*a* respectively in almost all directions. For this reason, the crosstalk reducing effect can be improved more greatly than that in the first embodiment in which the openings 37 are provided opposite to the subsidiary electrode regions 35*b*. Particularly in the second embodiment, the crosstalk reducing effect can be improved more greatly because the island portions 38 are connected to one another by the elongated bridges 39.

Between the main electrode regions 35*a* of two individual electrodes 35 adjacent to each other along the arrangement direction A, a land portion 36 connected to another individual electrode 35 is located. A portion of the common electrode 34*c* opposite to the land portion 36, however, little serves as an active layer causing displacement due to a piezoelectric effect. Accordingly, also in the inkjet printing head according to the second embodiment in which the pressure chambers 10 are arranged densely in the form of a matrix, an excellent crosstalk reducing effect can be obtained.

Although preferred embodiments of the invention have been described above, the invention is not limited to the embodiments described above and various changes on design may be made without departing from the scope of claim. For example, in the embodiments, openings may be formed in the common electrode so as to be opposite to part of the main electrode regions 35*a*. In this case, the openings may be opposite to the subsidiary electrode regions 35*b* or may not be opposite to the subsidiary electrode regions 35*b*. In any case, reduction in crosstalk can be attained.

In the second embodiment, the common electrode 34*c* may be provided opposite to part or all of the subsidiary electrode regions 35*b*. In this case, openings formed in the common electrode 34*c* may surround part of the subsidiary electrode regions 35*b*.

In the second embodiment, although the openings 40 surround the main electrode regions 35*a* in almost all directions except the directions of the bridges 39, openings formed in the common electrode 34*c* may surround the main electrode regions 35*a* in part of the directions.

In the embodiments, the individual electrodes 35 and the pressure chambers 10 are arranged in the form of a matrix so that the subsidiary electrode region 35*b* of one individual electrode 35 is located between the main electrode regions 35*a* of other two individual electrodes 35. In the invention, however, the pressure chambers 10 and the individual electrodes 35 need not be arranged in the form of a matrix as described in the embodiments. For example, the pressure chambers and the individual electrodes may be arranged in one direction. In any case, configuration may be made so that the individual electrodes and the common electrode are provided in portions of the actuator unit opposite to the pressure chambers 10 necessary for ink ejection but neither individual electrode nor common electrode is provided in each of other portions.

As described above, the inkjet printing head includes: a flow path unit including a plurality of pressure chambers arranged along a plane and connected to nozzles; and an actuator unit fixed on a surface of the flow path unit for changing the volume of each of the pressure chambers. The actuator unit includes: a plurality of individual electrodes arranged in positions opposite to the pressure chambers respectively; a common electrode provided so as to extend over the plurality of pressure chambers and have openings formed opposite to part of the individual electrodes; and a piezoelectric sheet sandwiched between the common electrode and the individual electrodes.

According to this configuration, because openings are formed in the common electrode, the piezoelectric sheet opposite to the openings is hardly displaced so that crosstalk between the pressure chambers can be reduced.

When each of the individual electrodes has a main electrode region disposed in a position opposite to corresponding one of the pressure chambers, and a subsidiary electrode region disposed in a position opposite to the outside of the pressure chamber and connected to the main electrode region, the common electrode may be formed so that each of the openings includes a portion opposite to at least one part of the subsidiary electrode region of a corresponding individual electrode. According to this configuration, because the openings are opposite to the subsidiary electrode regions disposed in positions opposite to the outside of the pressure chambers, that is, because the openings are opposite to portions of the piezoelectric sheet little contributing to ink ejection, the amount of displacement of the piezoelectric sheet opposite to the main electrode regions of the individual electrodes can be reduced.

In this case, the common electrode may be formed so that each of the openings includes a portion opposite to the subsidiary electrode region of a corresponding individual electrode. According to this configuration, the amount of displacement of the piezoelectric sheet opposite to the main electrode regions of the individual electrodes can be reduced more greatly.

Preferably, in this case, the subsidiary electrode regions may include connection terminals for performing electrical connection to the outside of the actuator unit. According to this configuration, the connection terminals for performing electrical connection to the outside of the actuator unit can be provided so as to be correspond to the openings not contributing to driving, so that the possibility that contact points of the connection terminals may be peeled by vibration caused by driving can be reduced.

In this case, it is preferable from the point of view of improving the crosstalk reducing effect that the common electrode may be formed so that the common electrode is not separated by the openings, and that the openings surround at least part of the main electrode regions of the individual electrodes. In this case, it is further preferable from the point of view of improving the crosstalk reducing effect more greatly that the common electrode may have a shape in which regions opposite to the main electrode regions of the individual electrodes are connected to one another by elongated bridge regions.

In the invention, the individual electrodes and the pressure chambers may be arranged in the form of a matrix so that the subsidiary electrode region of one individual electrode is located between the main electrode regions of other two individual electrodes. According to this configuration, an excellent crosstalk reducing effect can be obtained even in the case where the pressure chambers are arranged densely.

In another aspect, the inkjet printing head includes: a flow path unit including a plurality of pressure chambers arranged along a plane and connected to nozzles; and an actuator unit fixed onto a surface of the flow path unit for changing the volume of each of the pressure chambers. The actuator unit includes: a plurality of individual electrodes arranged in positions opposite to the pressure chambers respectively; a common electrode provided over the plurality of pressure chambers and having openings formed so as to be opposite to circumferential edges of the individual electrodes respectively; and a piezoelectric sheet sandwiched between the common electrode and the individual electrode.

According to this configuration, because openings are formed in the common electrode, the piezoelectric sheet opposite to the openings is hardly displaced so that crosstalk between the pressure chambers can be reduced. Moreover, because the voids regions are opposite to the circumferential edges of the individual electrodes, the openings can almost suppress worsening of ink ejection characteristic.

When each of the individual electrodes has a main electrode region disposed in a position opposite to corresponding one of the pressure chambers, and a subsidiary electrode region disposed in a position opposite to the outside of the pressure chamber and connected to the main electrode region, the common electrode may be formed so that the openings are opposite to regions outside the main electrode regions. According to this configuration, because the openings are opposite to the subsidiary electrode regions disposed in positions opposite to the outside of the pressure chambers, that is, because the openings are opposite to portions of the piezoelectric sheet little contributing to ink ejection, the amount of displacement of the piezoelectric sheet opposite to the subsidiary electrode regions of the individual electrodes can be reduced.

The printer according to the invention has at least one inkjet printing head as defined above.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An inkjet printing head comprising:

a flow path unit having a plurality of pressure chambers arranged along a plane and connected to nozzles; and an actuator unit fixed on a surface of the flow path unit and changes volume of each of the pressure chambers, the actuator unit including:

a plurality of individual electrodes arranged in positions opposite to the pressure chambers respectively, the individual electrodes being disposed only on a surface of the actuator unit opposite to a surface of the actuator unit fixed on the surface of the flow path unit;

a common electrode disposed to extend over the plurality of pressure chambers and having openings each formed at least at a part of a region opposite to the individual electrodes; and a piezoelectric sheet sandwiched between the common electrode and the individual electrodes.

2. The inkjet printing head according to claim 1, wherein each of the individual electrodes has a main electrode region disposed in a position opposite to corresponding one of the pressure chambers, and a subsidiary electrode region in which connected to the main electrode region and disposed in a position not opposite to the pressure chambers, and wherein each of the openings are formed at least at a part of a region opposite to the subsidiary electrode region.

3. The inkjet printing head according to claim 2, wherein a connection terminal that is to be electrically connected with an external terminal is formed on the subsidiary electrode region.

4. The inkjet printing head according to claim 2, wherein each of the openings are formed to surround at least part of the main electrode region.

5. The inkjet printing head according to claim 2, wherein the common electrode is continuously formed and is not separated by the openings.

6. The inkjet printing head according to claim 5, wherein each of the openings are formed to surround at least part of the main electrode region.

7. The inkjet printing head according to claim 5, wherein the common electrode is formed in a shape that each of regions opposite to corresponding main electrode regions are connected to one another by elongated bridge regions.

8. The inkjet printing head according to claim 2, wherein the pressure chambers and the individual electrodes are arranged in a form of matrix, and wherein each of the subsidiary electrode region of the individual electrodes are disposed in a position between each of the main electrode region of the adjacent individual electrodes.

9. A printer comprising:

a conveyance mechanism that conveys a recording medium; and a inkjet printing head that discharges ink on the recording medium and forms an image thereon, the inkjet printing head including:

a flow, path unit having a plurality of pressure chambers arranged along a plane and connected to nozzles; and an actuator unit fixed on a surface of the flow path unit and changes volume of each of the pressure chambers, the actuator unit including:

a plurality of individual electrodes arranged in positions opposite to the pressure chambers respectively, the individual electrodes being disposed only on a surface of the actuator unit opposite to a surface of the actuator unit fixed on the surface of the flow path unit;

a common electrode disposed to extend over the plurality of pressure chambers and having openings each formed at least at a part of a region opposite to the individual electrodes; and a piezoelectric sheet sandwiched between the common electrode and the individual electrodes.

10. The printer according to claim 9, wherein each of the individual electrodes has a main electrode region disposed in a position opposite to corresponding one of the pressure chambers, and a subsidiary electrode region in which connected to the main electrode region and disposed in a position not opposite to the pressure chambers, and wherein each of the openings are formed at least at a part of a region opposite to the subsidiary electrode region.

11. The printer according to claim 10, wherein a connection terminal that is to be electrically connected with an external terminal is formed on the subsidiary electrode region.

12. The printer according to claim 10, wherein each of the openings are formed to surround at least part of the main electrode region.

13. The printer according to claim 10, wherein the common electrode is continuously formed and is not separated by the openings.

14. The printer according to claim 13, wherein each of the openings are formed to surround at least part of the main electrode region.

15. The printer according to claim 13, wherein the common electrode is formed in a shape that each of regions opposite to corresponding main electrode regions are connected to one another by elongated bridge regions.

16. The printer according to claim 10, wherein the pressure chambers and the individual electrodes are arranged in a form of matrix, and wherein each of the subsidiary electrode region of the individual electrodes are disposed in a position between each of the main electrode region of the adjacent individual electrodes.

* * * * *